US006220977B1

(12) United States Patent
Stockhamer

(10) Patent No.: US 6,220,977 B1
(45) **Date of Patent: *Apr. 24, 2001**

(54) GAME DART FLIGHT GROOMING DEVICE

(76) Inventor: Lee Stockhamer, 1788 Horton Rd., Mohegan Lake, NY (US) 10547

( * ) Notice: Subject to any disclaimer, the term of this patent is extended or adjusted under 35 U.S.C. 154(b) by 0 days.

This patent is subject to a terminal disclaimer.

(21) Appl. No.: 09/481,244

(22) Filed: Jan. 11, 2000

Related U.S. Application Data

(63) Continuation of application No. 09/291,442, filed on Apr. 13, 1999, which is a continuation-in-part of application No. 08/837,542, filed on Apr. 21, 1997, now Pat. No. 5,921,874.

(51) Int. Cl.[7] ..... B26B 27/00; B26B 3/04

(52) U.S. Cl. ..... 473/569; 30/304

(58) Field of Search ..... 30/304, 305; 451/461, 451/552, 555, 558; 473/569

(56) References Cited

U.S. PATENT DOCUMENTS

| | | | |
|---|---|---|---|
| 1,360,765 | 11/1920 | Knowlton | 30/304 X |
| 3,050,911 | 8/1962 | Brittingham | 451/555 |
| 3,270,368 | 9/1966 | Cook et al. | 30/304 X |
| 3,735,542 | 5/1973 | Kocian | 451/461 |
| 4,001,982 | 1/1977 | Griffin et al. | 451/552 |
| 4,069,528 | 1/1978 | Newton et al. | 451/461 X |
| 4,455,784 | 6/1984 | Gallo | 30/304 X |
| 4,472,879 | 9/1984 | Sizemore | 30/304 |
| 4,635,406 | 1/1987 | Rumbaugh | 451/461 |
| 4,785,586 | 11/1988 | Kratfel | 451/552 |
| 4,974,273 | 12/1990 | Buttermore et al. | 7/170 |
| 5,068,954 | 12/1991 | Houska | 29/240 |
| 5,205,193 | 4/1993 | Wield | 81/176.15 |
| 5,921,874 * | 7/1999 | Stockhamer | 473/569 |

FOREIGN PATENT DOCUMENTS

| | | | |
|---|---|---|---|
| 407525 * | 11/1946 | (IT) | 451/555 |

* cited by examiner

*Primary Examiner*—John A. Ricci
(74) *Attorney, Agent, or Firm*—Hoffmann & Baron, LLP

(57) ABSTRACT

A dart tool (110) having a hollow housing (112). The dart tool (110) has a flight straightener (114) securely attached at a rear distal end to the housing (112). The flight straightener (114) has a flight straightener top (114T) which has a flight straightener top front (114TA) having a flight straightener top front right corner (114TAR) and a flight straightener top front left corner (114TAL). The flight straightener (114) further has a flight straightener bottom (114B) which has a flight straightener bottom front (114BA) having a flight straightener bottom front right corner (114BAR) and a flight straightener bottom front left corner (114BAL). A first sharpener (116) is securely positioned within the housing (112).

13 Claims, 9 Drawing Sheets

GAME DART FLIGHT GROOMING DEVICE

This application is a continuation of application Ser. No. 09/291,442, filed Apr. 13, 1999, which is a continuation-in-part of application Ser. No. 08/837,542, filed Apr. 21, 1997, now U.S. Pat. No. 5,921,874.

BACKGROUND OF THE INVENTION

1. Field of the Invention

The present invention relates to the game of darts. More particularly, the present invention relates to a device to maintain darts, including; grooming the fins or flights of darts, shaft tightener, and a broken shaft remover.

2. Description of the Prior Art

A game dart is essentially a hand thrown fin stabilized projectile. The fins in combination are called a flight. While early darts used feather material for the construction of flights, modern darts now use various materials which have been proven to maintain a preselected aerodynamic shape and alignment. Typically, the flights are made from a synthetic material. Through use the flights sustain damage which effects the aerodynamic performance of the dart resulting in reduced accuracy and consistency of flight. What is needed is a device which can groom the flights to restore the aerodynamic performance.

Numerous innovations for dart tools have been provided in the prior art that are adapted to be used. Even though these innovations may be suitable for the specific individual purposes to which they address, they would not be suitable for the purposes of the present invention as heretofore described.

SUMMARY OF THE INVENTION

The present invention is a hand held device having a double bladed tool which conditions the flights removing or reducing nicks and notches which occur through use. The present invention has a handle attached to a plurality of blades extending radially outward from the handle. A recess is formed between the blades. The blades are positioned to accept the flights of the dart. In use, a flight is slid through a recess in the blades which are squeezed together by the user, this action removes or compresses a small portion of the flight which restores the flight to a flight worthy condition.

The types of problem encountered in the prior art are maintenance of game darts including; restoring aerodynamic surfaces of dart flights by removing nicks and notches in flights, removing broken shafts and tightening shafts.

The present invention solves the problem of restoring aerodynamic surfaces of dart flights by removing or reducing nicks and notches in the flights by reshaping the flight until the nicks and notches are removed or reduced.

The present invention solves the problem of removing broken shafts by providing a tool which engages the broken shaft end and permits twisting the shaft in the tip. The tool has a pair of posts which are sharpened. The sharpened ends of the posts are inserted into the broken end of the shaft. The posts are recessed within the tool to permit safe pocket storage.

The present invention solves the problem of tightening shafts by providing a post which is inserted into the shaft hole and in cooperation with the tool provides leverage for tightening or loosening shafts.

Innovations within the prior art are rapidly being exploited as dart throwing increases in popularity.

The present invention fills a long felt need for a device which restores the aerodynamic properties of the flights.

In keeping with these objects, and with other which will become apparent hereinafter, one feature of the present invention resides, briefly stated, in a flight straightener.

In keeping with these objects, and with other which will become apparent hereinafter, one feature of the present invention resides, briefly stated, in a dart tool.

When the dart tool is designed in accordance with the present invention, the flights are restored to a flight worthy aerodynamic condition.

Accordingly, it is an object of the present invention to provide a flight straightener having a flight straightener top.

In accordance with another feature of the present invention, the flight straightener has a flight straightener top and flight straightener bottom.

Another feature of the present invention is that the straightener top has a flight straightener top front which has a flight straightener top front right corner and a flight straightener top front left corner.

Yet another feature of the present invention is that the flight straightener bottom has a flight straightener bottom front which has a flight straightener bottom front right corner and a flight straightener bottom front left corner.

Still another feature of the present invention is that the first dart tool has a first housing which contains a first sharpener, a first sharpener opening and a third sharpener.

Yet still another feature of the present invention is that the third sharpener has a third sharpener opening, and a third sharpener shaft connector remover.

Still yet another feature of the present invention is that a second dart tool has a second housing.

Another feature of the present invention is that the second housing has a second housing channel, second housing post, second sharpener, and a second sharpener opening.

Still yet another feature of the present invention is that a flight straightener top and flight straightener bottom, in an operable position, are parallel to the flight.

Another feature of the present invention is that a flight straightener top and flight straightener bottom have peripheral edges which are not sharpened, functioning to permit safe use and pocket storage.

Still yet another feature of the present invention is that a flight straightener to and flight straightener bottom do not require a shield to protect the user when the first dart tool (110) is stored and during use.

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawings.

LIST OF REFERENCE NUMERALS UTILIZED IN THE DRAWINGS

COMMON COMPONENTS

114—flight straightener (114)
114T—flight straightener top (114T)
114TA—flight straightener top front (114TA)
114TAR—flight straightener top front right corner (114TAR)
114TAL—flight straightener top front left corner (114TAL)

114B—flight straightener bottom (114B)
114BA—flight straightener bottom front (114BA)
114BAR—flight straightener bottom front right corner (114BAR)
114BAL—flight straightener bottom front left corner (114BAL)

FIRST EMBODIMENT

110—first dart tool (110)
112—first housing (112)
116—first sharpener (116)
116A—first sharpener opening (116A)
316—third sharpener (316)
316A—third sharpener opening (316A)
316B—third sharpener shaft connector remover (316B)
316BA—third sharpener shaft connector remover plate (316BA)
316BB—third sharpener shaft connector remover spike (316BB)

SECOND EMBODIMENT

210—second dart tool (210)
212—second housing (212)
212A—second housing channel (212A)
212B—second housing post (212B)
216—second sharpener (216)
216A—second sharpener opening (216A)

DESCRIPTION OF THE PREFERRED EMBODIMENT

Figure 1:
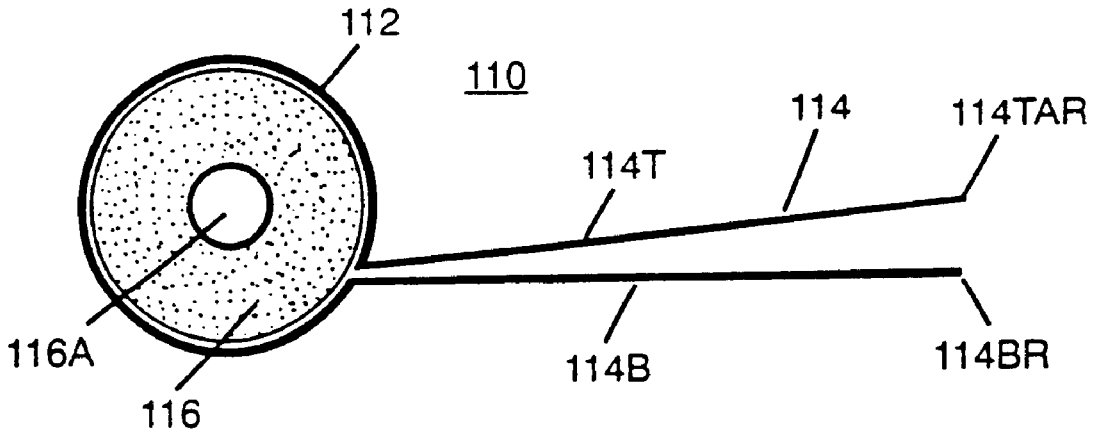
FIG. 1 is a side view of a first dart tool.
Figure 2:
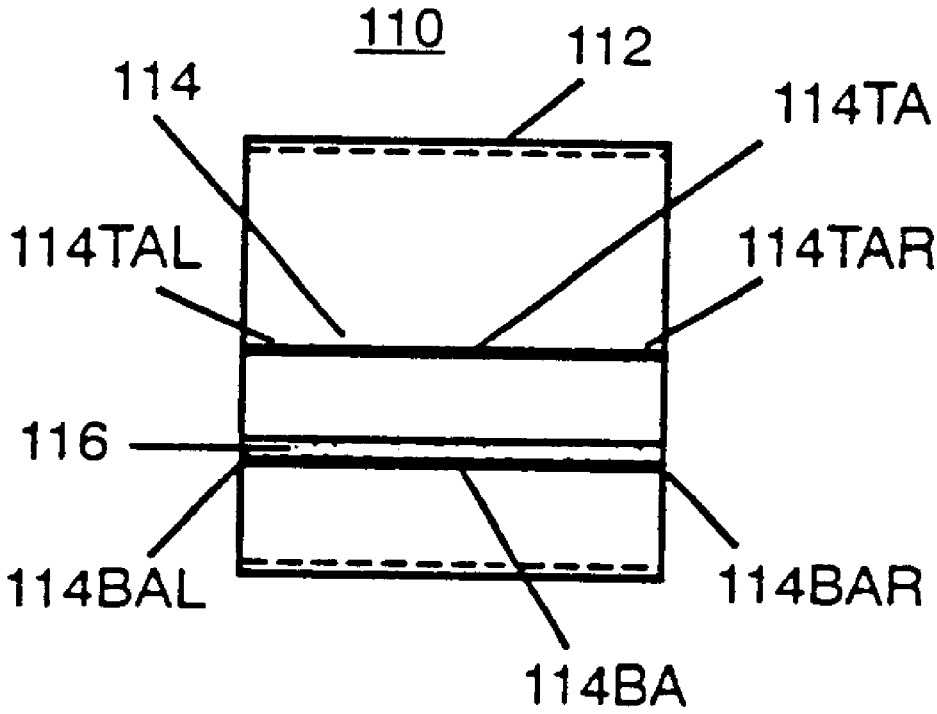
FIG. 2 is a front view of a first dart tool.

Firstly, referring to FIG. 1 which is a side view of a first dart tool (110) and FIG. 2 which is a front view of a first dart tool (110). The first dart tool (110) comprises a hollow first housing. The first dart tool (110) further comprises a flight straightener (114) which is securely attached at a rear distal end to the first housing (112). The first housing (112) and the flight straightener (114) are constructed from a material selected from a group consisting of metal, metal alloy, plastic, plastic composite, epoxy, fiberglass, and carbon-graphite.

The flight straightener (114) comprises a flight straightener top (114T) which comprises a flight straightener top front (114TA) having a flight straightener to front right corner (114TAR) and a flight straightener top front corner (114TAL). The flight straightener top front right corner (114TAR) and the flight straightener top front left corner (114TAL) and the flight straightener bottom front right corner (114BAR) and the flight straightener bottom front left corner (114BAL) are rounded functioning to prevent damage to the flight during use. The flight straightener (114) further comprises a flight straightener bottom (114B) which comprises a flight straightener bottom front (114BA) having a flight straightener bottom front right corner (114BAR) and a flight straightener bottom front left corner (114BAL).

In operation a flight, having at least one edge, is inserted between the flight straightener top (114T) and the flight straightener bottom (114B) such that the flight straightener top (114T) and the flight straightener bottom (114B) straddles the at least one edge. The user moves the first dart tool (110) generally parallel to the at least one edge while squeezing the flight straightener bottom (114B) and the flight straightener top (114T) together. This motion alternatively smooths and scrapes material from the surface of the flight.

Alternatively, the flight is inserted between the flight straightener top (114T) and the flight straightener bottom (114B) such that the flight straightener top (114T) and the flight straightener bottom (114B) are generally perpendicular to the at least one edge of the flight. The user moves the first dart tool (110) generally perpendicularly and outwardly to the at least one edge while squeezing the flight straightener bottom (114B) and the flight straightener top (114T) together. This motion smooths the surface of the flight.

This motion may result in filaments of flight material attached to the at least one edge of the flight at one end and the opposite end extending beyond the at least one edge of the flight. These filaments can cause degradation of aerodynamic flight. The filaments are removed by inserting the filaments between the flight straightener top (114T) and the flight straightener bottom (114B) such that the flight straightener top (114T) and the flight straightener bottom (114B) are generally perpendicular to the at least one edge. The insertion is stopped when the flight straightener top front (114TA) and flight straightener bottom front (114BA) are positioned at the inner end of the filament. When the user squeezes the flight straightener top (114T) and the flight straightener bottom (114B) together and pulls the first dart tool (110) generally perpendicularly and outwardly to the at least one edge of the flight the filaments are removed.

The flight straightener top (114T) and flight straightener bottom (114B) have peripheral edges having a shape selected from a group consisting of not sharpened, sharpened, rounded and square which functions to protect adjacent fins, a dart shaft, and the user.

The first dart tool (110) still further comprises a first sharpener (116) securely positioned within the first housing (112). The first sharpener (116) comprises a first sharpener opening (116A) in which a user sharpens a dart point. The first sharpener (116) is constructed of a material selected from a group consisting of stone, diamond cutting material, cubic zirconium, stone composites, and composites.

Figure 3:
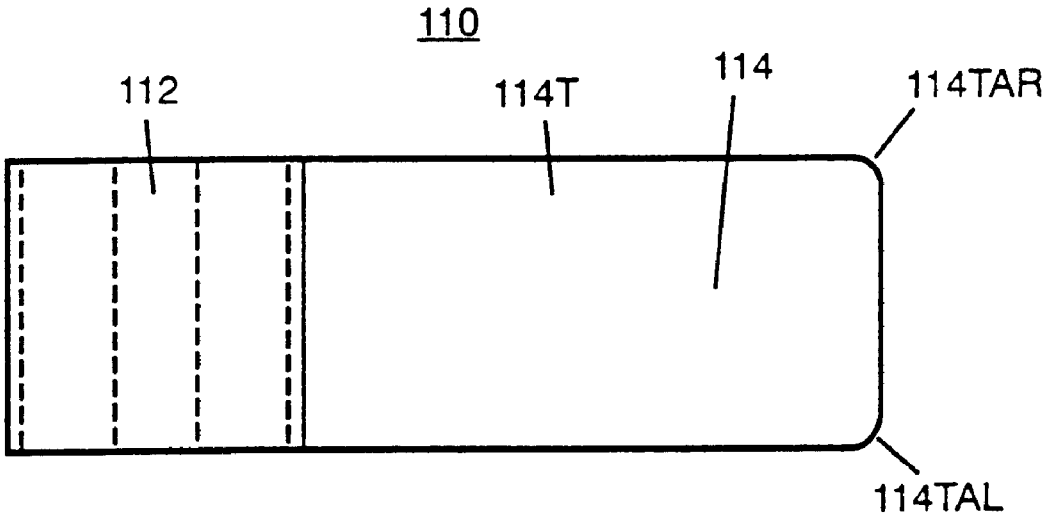
FIG. 3 is a top view of a first dart tool.

Secondly, referring to FIG. 3 which is a top view of a first dart tool (110). The first dart tool (110) comprises a hollow first housing. The first dart tool (110) further comprises a flight straightener (114) which is securely attached at a rear distal end to the first housing (112).

The flight straightener (114) comprises a flight straightener top (114T) which comprises a flight straightener top front (114TA) having a flight straightener top front right corner (114TAR) and a flight straightener top front corner (114TAL).

Figure 4:
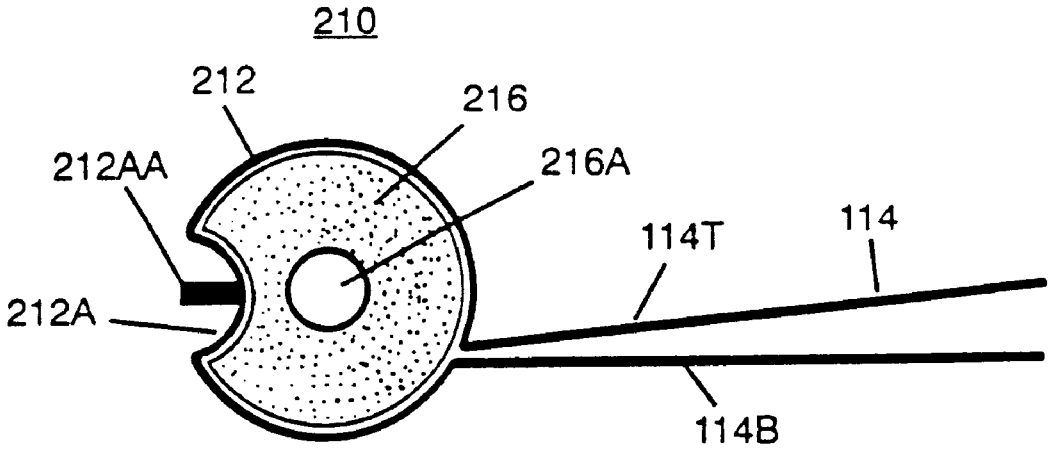
FIG. 4 is a side view of a second dart tool.
Figure 5:
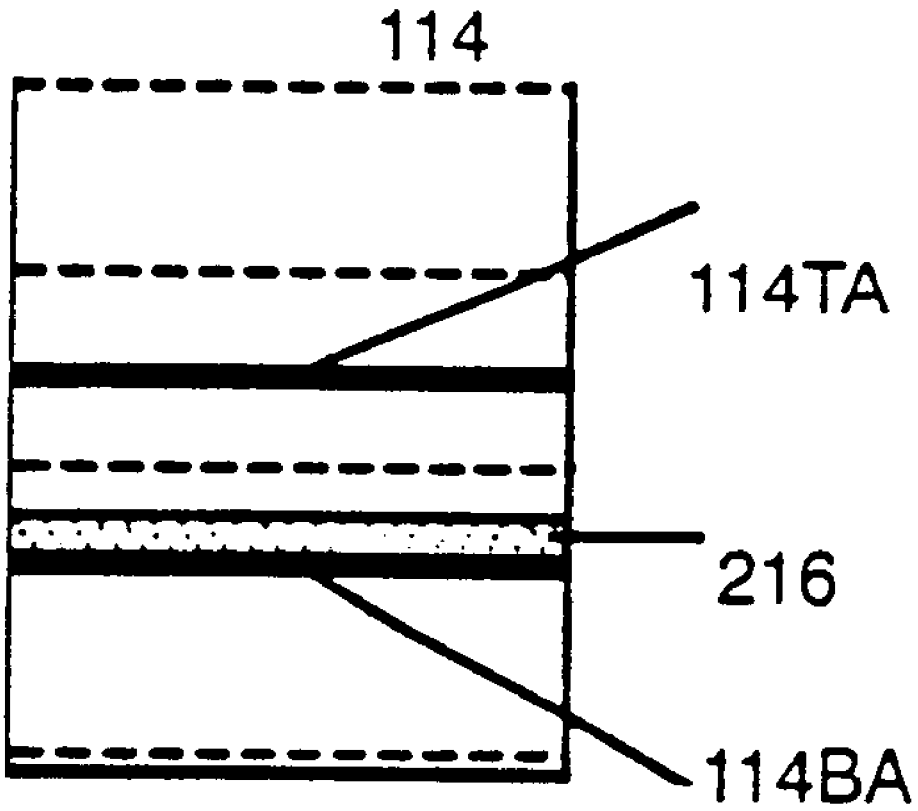
FIG. 5 is a front view of a second dart tool.
Figure 6:
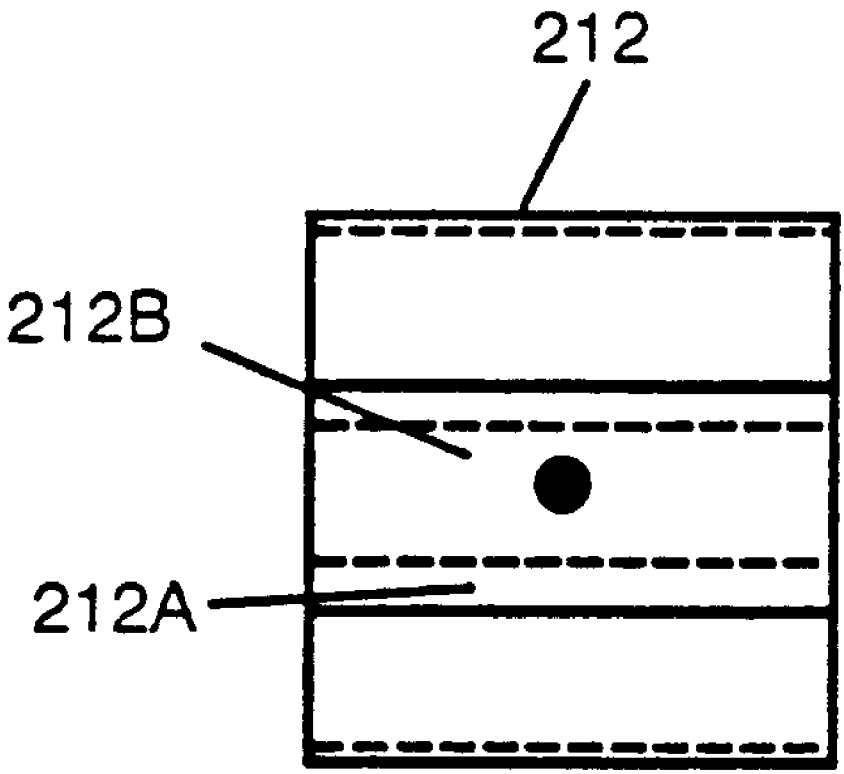
FIG. 6 is a rear view of a second dart tool.
Figure 7:
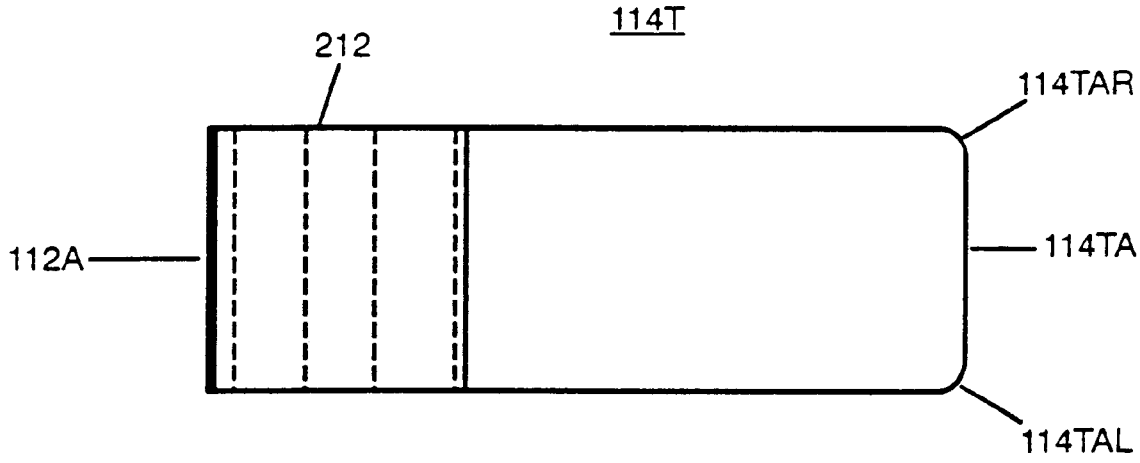
FIG. 7 which is a top view of a first dart tool.

Thirdly, referring to FIG. 4 which is a side view of a second dart tool (210), FIG. 5 which is a front view of the second dart tool (210), FIG. 6 which is a rear view of the second dart tool (210) and FIG. 7 which is a top view of the first dart tool (210) all together. The second dart tool (210) comprises a second housing (212) which comprises a second housing channel (212A) functioning to cradle a dart shaft therein. A second housing post (212B) is securely attached within the second housing channel (212A) extending upwardly therefrom. The second housing post (212B) is positioned in an opening in a dart shaft functioning to hold the dart shaft in place while a user tightens or loosens a dart head. A second sharpener (216) is positioned within the second housing (212). The second sharpener (216) comprises a second sharpener opening (216A). The second sharpener (216) is constructed from stone.

The second dart tool (210) further comprises a flight straightener (114) securely attached at a rear distal end to the second housing (212). The flight straightener (114) comprises a flight straightener top (114T) which comprises a flight straightener top front (114TA) having a flight straightener top front right corner (114TAR) and a flight straightener top front left corner (114TAL). The flight straightener (114) further comprises a flight straightener bottom (114B) which comprises a flight straightener bottom front (114BA) having a flight straightener bottom front right corner (114BAR) and a flight straightener bottom front left corner (114BAL). The flight straightener top front right corner (114TAR) and the flight straightener top front left corner (114TAL) and the flight straightener bottom front right corner (114BAR) and the flight straightener bottom front left corner (114BAR) are rounded functioning to prevent damage to the flight during use.

The second housing (212) and the flight straightener (114) are constructed from a material selected from a group consisting of metal, metal alloy, plastic, plastic composite, epoxy, fiberglass, and carbon-graphite.

Figure 8:
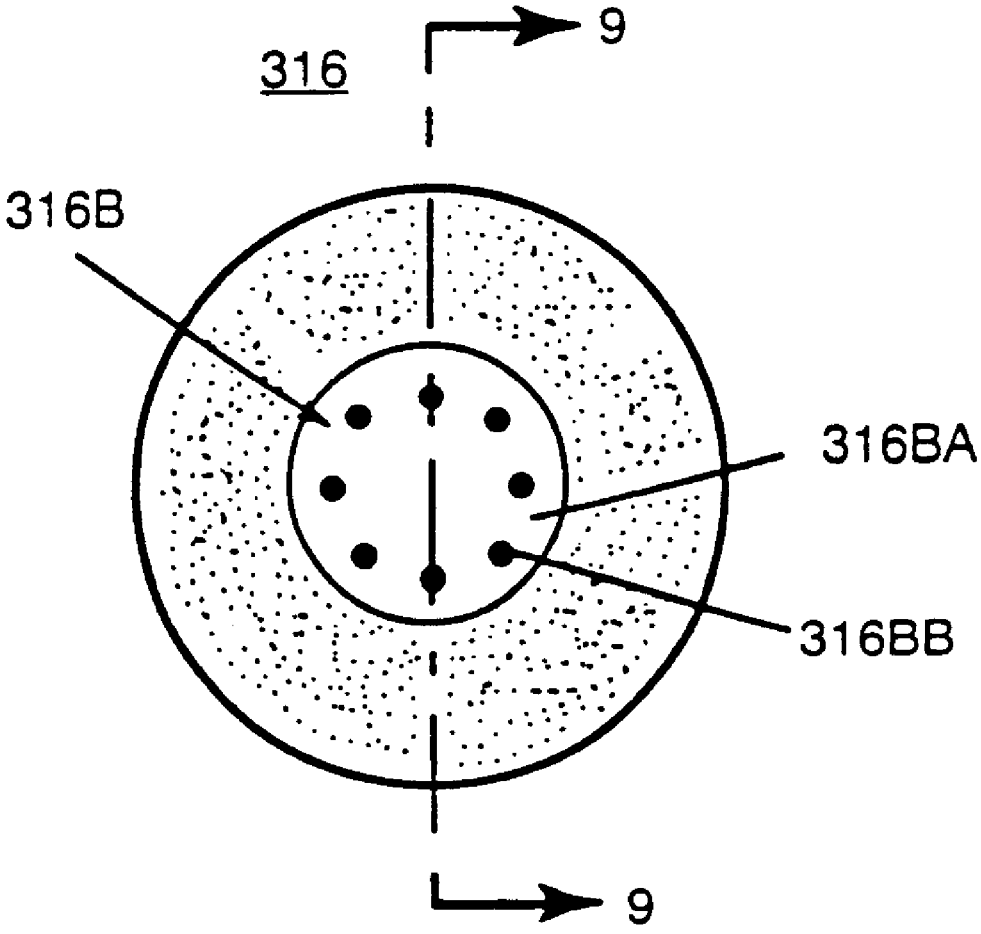
FIG. 8 is a top view of a third sharpener.
Figure 9:
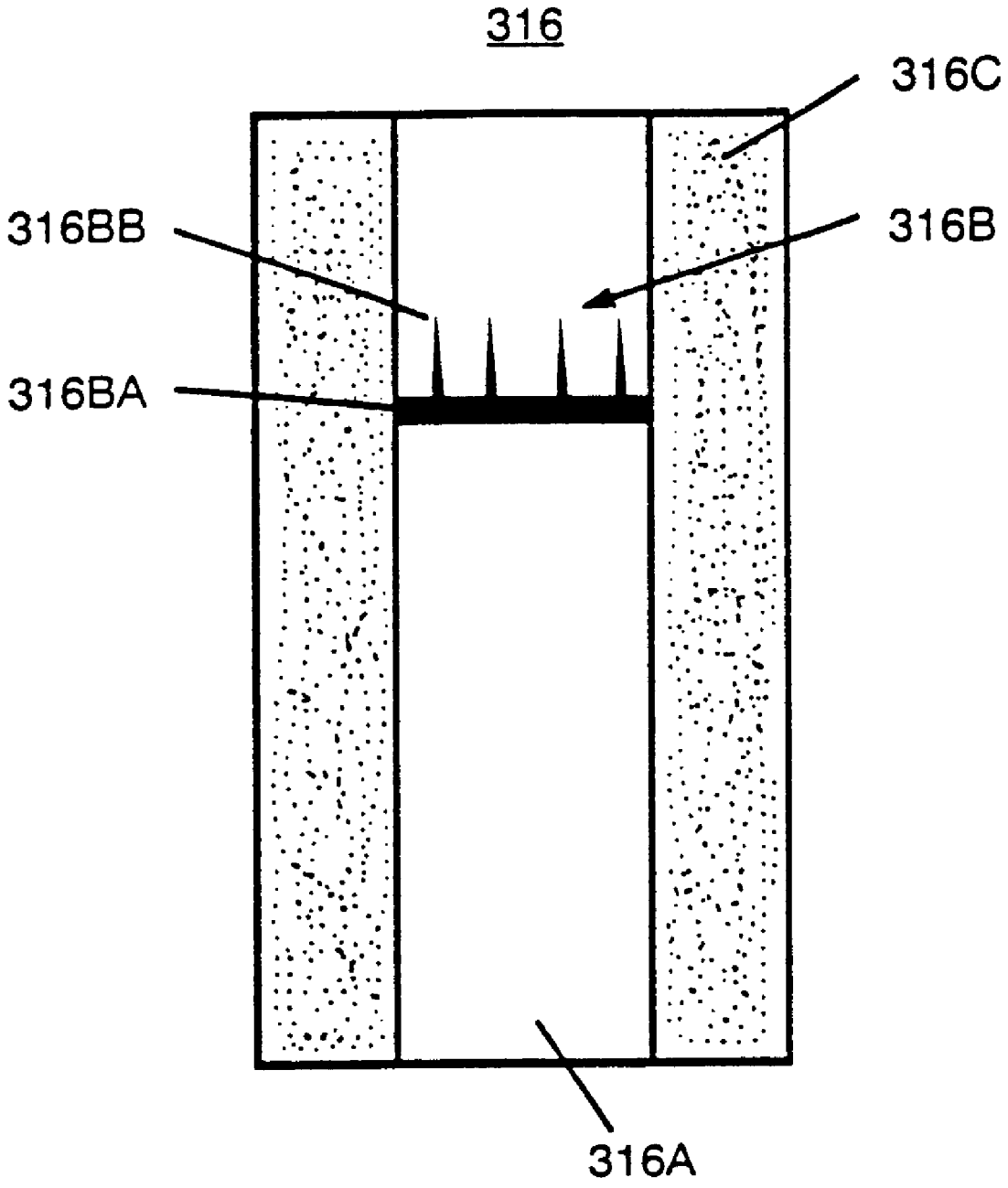
FIG. 9 is a cross sectional view of a third sharpener along line 9—9.

Lastly, referring to FIG. 8 which is a top view of a third sharpener (316), and FIG. 9 which is a cross sectional view of a third sharpener (316) along line 9—9. The third sharpener (316) comprises a cylindrical third sharpener opening (316A) and a third sharpener shaft connector remover (316B) positioned within the third sharpener opening (316A). The third sharpener (316) is constructed from stone.

The third sharpener shaft connector remover (316B) comprises a third sharpener shaft connector remover plate (316BA) having at least two third sharpener shaft connector remover spikes (316BB) positioned around a periphery extending upwardly therefrom. The third sharpener shaft connector remover (316B) functions to remove a broken plastic dart shaft connector from a dart head. The at least two third sharpener shaft connector remover spikes (316BB) are recessed within the third sharpener (316) permitting the third sharpener (316) to be inserted into a user's pocket without incurring a prick from the at least two third sharpener shaft connector remover spikes (316BB).

It will be understood that each of the elements described above, or two or more together, may also find a useful application in other types of constructions differing from the type described above.

While the invention has been illustrated and described as embodied in a dart tool, it is not intended to be limited to the details shown, since it will be understood that various omissions, modification, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

What is claimed is:

1. A dart tool comprising:

a housing, a flight straightener which is attached to said housing, said flight straightener comprising a top and a bottom, each having a flat construction and peripheral edge, which are squeezed together by a user while a dart flight is slid between said top and bottom, whereby the surface of said flight is smoothed and/or material is scraped therefrom.

2. A dart tool as described in claim 1 wherein said housing is cylindrical.

3. A dart tool as described in claim 1 wherein said edges have a shape selected from a group consisting not sharpened, sharpened, rounded, and square.

4. A dart tool as described in claim 3 wherein said edges are rounded to prevent damage to said flight during use.

5. A dart tool as described in claim 3 wherein said edges are square.

6. A dart tool as described in claim 1 which further comprises a sharpener secured in said housing.

7. A dart tool as described in claim 6 wherein said sharpener comprises an opening in which a user sharpens a dart point.

8. A dart tool as described in claim 6 wherein said sharpener is constructed of a material selected from a group consisting of stone, diamond cutting material, cubic zirconium, stone composites and composites.

9. A dart tool as described in claim 6 wherein said sharpener further comprises a shaft connector remover comprising a sharpener shaft connector remover plate having at least two shaft connector remover spikes extending upwardly from said plate.

10. A dart tool as described in claim 9 wherein said at least two shaft connector remover spikes are positioned around a periphery of said plate.

11. A dart tool as described in claim 1 wherein said housing and said flight straightener are constructed from a material selected from a group consisting of metal, metal alloy, plastic, plastic composite, epoxy, fiber glass, and carbon-graphite.

12. A dart tool as described in claim 1, wherein said housing further comprises a dart shaft holder by which a dart shaft is held in place while said user tightens or loosens a dart head.

13. A dart tool as described in claim 12, wherein said dart shaft holder comprises a channel in said housing to cradle a dart shaft, and a post securely attached within said channel and extending upwardly therefrom whereby said post is positioned in an opening in a dart shaft to hold said dart shaft in place while said user tightens or loosens said dart head.

* * * * *